US005366361A

United States Patent [19]

Mori et al.

[11] Patent Number: 5,366,361

[45] Date of Patent: Nov. 22, 1994

[54] VANE PUMP

[75] Inventors: Hiromitsu Mori, Ikoma; Chikara Kobayashi, Hamamatsu, both of Japan

[73] Assignee: Osaka Gas Co., Ltd., Osaka, Japan

[21] Appl. No.: 940,472

[22] Filed: Sep. 4, 1992

[51] Int. Cl.[5] ..... F01C 1/00

[52] U.S. Cl. ..... 418/261; 418/265

[58] Field of Search ..... 418/260, 261, 265

[56] References Cited

U.S. PATENT DOCUMENTS

| | | | |
|---|---|---|---|
| 1,393,698 | 10/1921 | Platt | 418/265 |
| 2,312,961 | 3/1943 | Cowherd | 418/265 |
| 2,443,994 | 6/1948 | Scognamillo | 418/265 |
| 2,590,728 | 3/1952 | Scognamillo | 418/265 |
| 4,494,918 | 1/1985 | Nozaki | 418/260 |
| 5,069,608 | 12/1991 | Rather | 418/261 |

*Primary Examiner*—Richard A. Bertsch
*Assistant Examiner*—Charles G. Freay
*Attorney, Agent, or Firm*—Gifford, Groh, Sprinkle, Patmore and Anderson

[57] ABSTRACT

A vane pump has a casing, a rotor rotatably mounted in the casing, and a plurality of vanes mounted in the rotor and projecting variable amounts from an outer peripheral wall of the rotor. The outer peripheral wall of the rotor and an inner peripheral wall of the casing are shaped cylindrical. The rotor has an axis of rotation offset from the center of the inner peripheral wall of the casing. Stationary cams concentric with the inner wall of the casing act on proximal ends of the vanes, so that distal ends of the vanes revolve in close vicinity of but not in pressure contact with the inner wall of the casing.

1 Claim, 2 Drawing Sheets

VANE PUMP

BACKGROUND OF THE INVENTION

1. Field of the Invention

This invention relates to vane pumps, and more particularly to a vane pump having a rotor rotatably mounted in a casing, an outer peripheral wall of the rotor and an inner peripheral wall of the casing opposed to the outer peripheral wall being shaped cylindrical, the rotor having an axis of rotation offset from the center of the inner peripheral wall of the casing, and a plurality of vanes mounted in the rotor and projecting variable amounts from the outer peripheral wall of the rotor, the vanes being revolvable with rotation of the rotor, with distal ends of the vanes movable along the inner peripheral wall of the casing.

2. Description of the Related Art

Conventionally, the vanes have spring-loaded proximal ends for strongly pressing distal ends thereof against the inner peripheral wall of the casing. However, the vanes and the inner wall of the casing tend to wear through sliding contact with each other. The springs also tend to break through fatigue. Thus, the conventional vane pump has a disadvantage with respect to durability.

SUMMARY OF THE INVENTION

An object of the present invention is to provide a vane pump having a greatly increased durability with an improved structure for revolving the distal ends of the vanes along the inner peripheral wall of the casing. The above object is fulfilled, according to the present invention, by a vane pump wherein the vanes are subjected to guiding action of guide means such that the distal ends revolve in close vicinity of and without pressure-contacting the inner peripheral wall of the casing.

This vane pump has the following functions and effects.

The guide means, for example, comprise cylindrical cam surfaces for acting on the proximal ends of the vanes or a guide member defining an annular groove for receiving engaging pieces of the vanes, to allow the distal ends of the vanes to revolve without strongly pressing against the inner wall of the casing. Consequently, the vanes may be revolved with hardly any wear occurring to the vanes, the inner wall of the casing or the guide means. Moreover, in the absence of springs, the possibility of fatigue failure is positively eliminated.

Since the guide means cause the distal ends to revolve along and in close vicinity of the inner peripheral wall of the casing, the space between the casing and rotor is reliably divided to secure a sufficient transmitting performance. Thus, the invention provides a highly durable vane pump, with hardly any wear occurring to the vanes, casing and the like, and without the possibility of fatigue failure.

According to the present invention, where the guide means comprise cams having outer peripheral walls acting on the distal ends of the vanes, the construction and manufacturing processes are simplified, which provides the advantage of effectively reducing manufacturing cost. Further, the inner peripheral wall of the casing and the outer peripheral walls of stationary cams may be shaped, in a range of vane revolution where the vanes are subjected to a strong pressing force due to a difference between inlet pressure and outlet pressure, to be substantially concentric with the cylindrical outer wall of the rotor. Then, durability is further promoted with reliable restriction of wear of the vanes and rotor due to sliding movement of the vanes relative to the rotor. The foregoing and other objects, features and advantages of the invention will be apparent from the following more particular description of preferred embodiments of the invention, as illustrated in the accompanying drawings.

DETAILED DESCRIPTION OF THE PREFERRED EMBODIMENTS

Vane pumps according to the present invention will be described in detail hereinafter with reference to the drawings.

Figure 1:
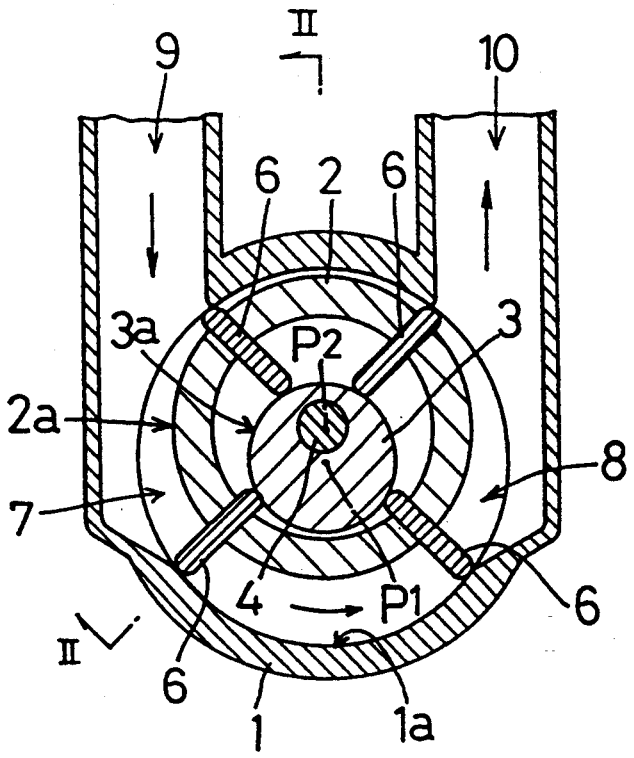
FIG. 1 is a sectional view showing an embodiment of the present invention.
Figure 2:
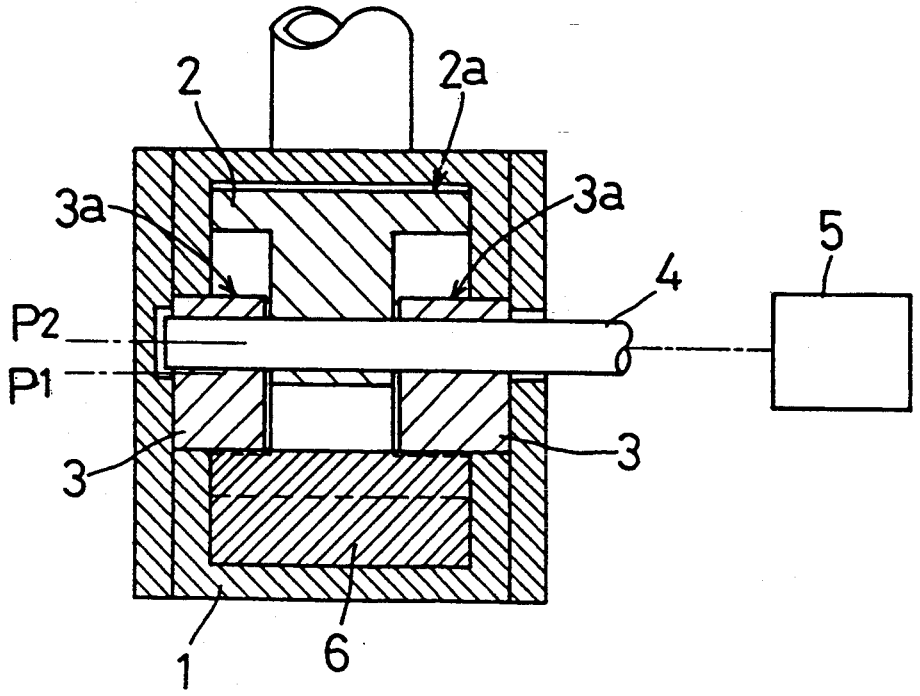
FIG. 2 is a section taken on line II—II of FIG. 1.

FIGS. 1 and 2 show a vane pump in a first embodiment of the invention. This vane pump includes a casing 1 containing a rotor 2 driven by a drive shaft 4 extending through the casing 1 and a pair of stationary cams 3 and connected to a drive unit 5. The rotor 2 has an outer peripheral wall 2*a* of cylindrical shape, while the casing 1 has an inner peripheral wall 1*a* also of cylindrical shape and opposed to the outer wall 2*a* of the rotor 2. The rotor 2 has an axis of rotation P2 offset from the center P1 of the inner wall 1*a* of the casing 1. The outer wall 2*a* of the rotor 2 and the inner wall 1*a* of the casing 1 lie close to each other in one location to an extent of forming almost no space therebetween.

Four vanes 6 are fitted in cutouts of the rotor 2 to project variable amounts from the outer wall 2*a* thereof. The cams 3 have outer peripheral wails 3*a* disposed close to proximal ends of the vanes 6 to act as guide surfaces. The outer peripheral walls 3*a* of the cams 3 are concentric with the inner peripheral wall 1*a* of the casing 1. Distal ends of the vanes 6 are arranged close to the inner wall 1*a* of the casing 1.

Thus, the vanes 6 revolve with rotation of the rotor 2, and project variable amounts from the outer wall 2*a* of the rotor 2. The distal ends of the vanes 6, by the guiding action of the cams 3, revolve in close vicinity of but not in pressure contact with the inner wall 1*a* of the casing 1. Consequently, the inner wall 1*a* of the casing 1, the vanes 6, and the outer walls 3*a* of the cams 3 are safeguarded against wear.

The inner wall 1*a* of the casing 1 defines an inlet 7 and an outlet 8. The vanes 6, in their movement from the inlet 7 to the outlet 8, pass through a position where the rotor 2 and the inner wall 1*a* of the casing 1 have a maximum distance therebetween, and, in their movement from the outlet 8 to the inlet 7, pass through a position where the rotor 2 and the inner wall 1*a* of the casing 1 have a minimum distance therebetween. That is, the capacity of a space defined by the casing 1, the rotor 2 and an adjacent pair of vanes 6 increases in a position to communicate with the inlet 7, and decreases in a position to communicate with the outlet 8, both with revolution of the vanes 6. Thus, fluid is forcibly transmitted from an intake passage 9 to a discharge passage 10.

Figure 3:
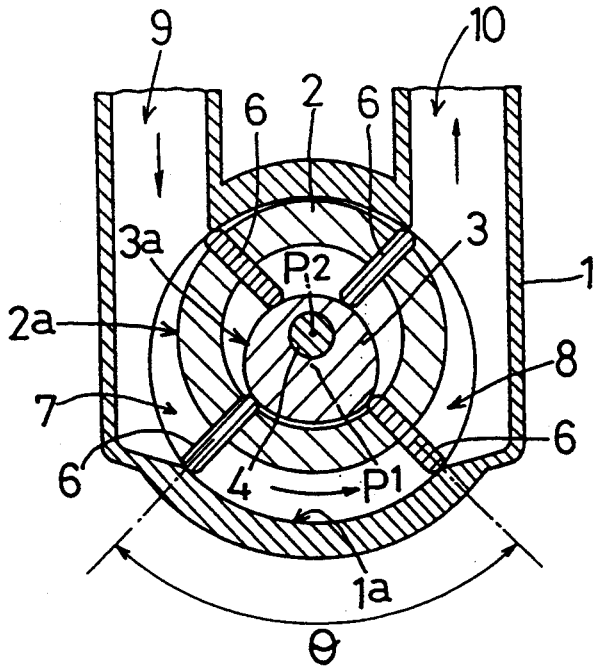
FIG. 3 is a sectional view of another embodiment.

FIG. 3 shows another embodiment, in which like parts are labeled with like reference numerals with respect to the foregoing embodiment, and will not be described again.

In this embodiment, the inner peripheral wall 1*a* of the casing 1 and the outer peripheral walls 3*a* of the cams 3 are shaped (substantially cylindrical), in a range of vane revolution $\theta$ from the inlet 7 to the outlet 8, to be substantially concentric with the cylindrical outer wall 2*a* of the rotor 2.

The vanes 6, in their movement from the inlet 7 to the outlet 8, are subjected to a great external force due to a differential pressure between inlet and outlet. With the inner wall 1*a* of the casing 1, the outer wall 2*a* of the rotor 2 and the outer walls 3*a* of the cams 3 arranged substantially concentric, there occurs little or no sliding of the vanes 6 relative to the rotor 2. Thus, this construction checks wear due to a sliding contact under strong pressure between the vanes 6 and rotor 2.

The number of vanes 6 may be varied as desired.

The shape, mounting structure and drive arrangement of the rotor 2 are variable. For example, the drive unit may be rotatable in opposite directions. Only one cam 3 may be used and mounted rotatable about the center P1 of the inner peripheral wall 1*a* of the casing 1.

Figure 4:
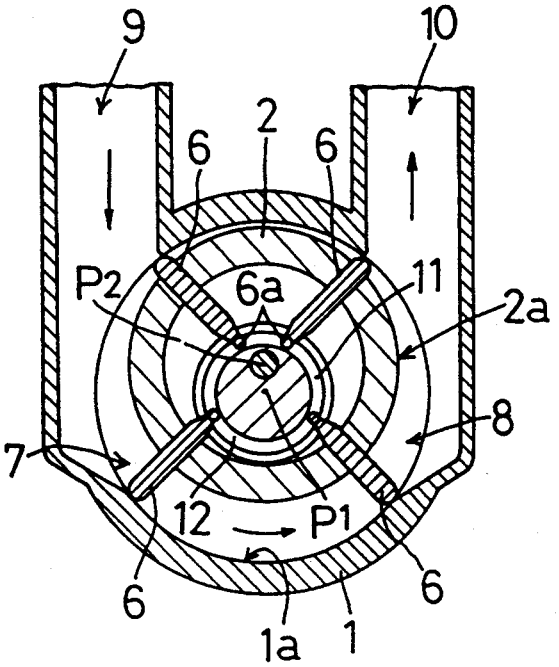
FIG. 4 is a sectional view of a further embodiment.

The cams 3 may be replaced by a different construction for guiding the vanes 6. One of the following constructions (a) and (b) may be employed, for example: (a) As shown in FIG. 4, vanes 6 have engaging pieces 6*a* fitted in an annular groove 11 formed in a guide member 12 to be concentric with the inner peripheral wall 1*a* of the casing 1.

Figure 5:
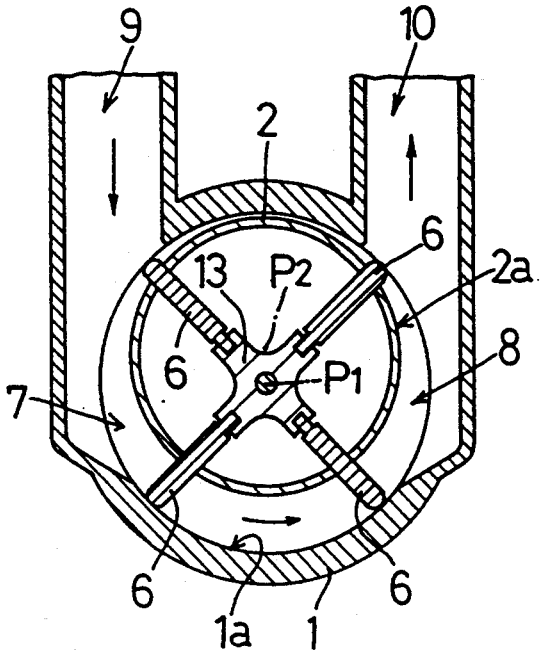
FIG. 5 is a sectional view of a still further embodiment.

(b) As shown in FIG. 5, vanes 6 are engaged with or connected through shafts to a rotary element 13 rotatable about the center P1 of the inner peripheral wall 1*a* of the casing 1.

The specific construction of the entire vane pump is immaterial, and so is application of the vane pump. However, the illustrated vane pumps are well suited for maintenance-free applications, such as for handling a refrigerant, absorbent or heat carrying fluid used in an absorption water cooler or heater.

What is claimed is:

1. A vane pump comprising:

a casing including an inner peripheral wall which has a substantially cylindrical shape and a center;

a rotor rotatably mounted in said casing and including an outer peripheral wall having a substantially cylindrical shape, said rotor having an axis of rotation offset from said center of said inner peripheral wall of said casing;

a plurality of vanes mounted in said rotor and having a portion projectable in variable amounts from said outer peripheral wall of said rotor, each of said plurality of vanes having a proximal end and a distal end, said distal ends of said vanes being movable along said inner peripheral wall of said casing; and at least one cam fixed to said casing so as to be substantially coaxial with said inner peripheral wall of said casing, said cam having a substantially cylindrical outer peripheral wall defining a guide surface for acting on said proximal ends of said vanes;

wherein said proximal ends of said vanes are subjected to the guiding action of said guide surface of said cam to project said vanes from said rotor, said inner peripheral wall of said casing in turn acting on said distal ends of said vanes to retract said vanes within said rotor and against said guide surface of said cam;

wherein a portion of said inner peripheral wall of said casing and a portion of said outer peripheral wall of said cam are shaped, in a range of vane revolution from an inlet to an outlet of said casing, to be substantially concentric with a portion of said outer wall of said rotor, said rotor and said vanes being maintained in a constant position relative to each other in said range such that said portion of said vanes being projected from said rotor is constant throughout said range of vane revolution and so that there occurs no sliding of said vanes relative to said rotor;

whereby wear due to sliding contact between said vanes and said rotor throughout said range of vane revolution is avoided.

* * * * *